US011071327B2

(12) United States Patent
Jain et al.

(10) Patent No.: US 11,071,327 B2
(45) Date of Patent: Jul. 27, 2021

(54) DEVICE WITH LIQUID FLOW RESTRICTION

(71) Applicant: NICOVENTURES HOLDINGS LIMITED, London (GB)

(72) Inventors: Siddhartha Jain, London (GB); Wade Tipton, London (GB); Rupert Barton, London (GB); William Harris, London (GB); Rory Fraser, London (GB)

(73) Assignee: Nicoventures Trading Limited, London (GB)

( * ) Notice: Subject to any disclaimer, the term of this patent is extended or adjusted under 35 U.S.C. 154(b) by 307 days.

(21) Appl. No.: 16/335,096

(22) PCT Filed: Sep. 11, 2017

(86) PCT No.: PCT/GB2017/052655
§ 371 (c)(1),
(2) Date: Mar. 20, 2019

(87) PCT Pub. No.: WO2018/055334
PCT Pub. Date: Mar. 29, 2018

(65) Prior Publication Data

US 2019/0274359 A1 Sep. 12, 2019

(30) Foreign Application Priority Data

Sep. 21, 2016 (GB) ..... 1616036

(51) Int. Cl.
*A24F 40/51* (2020.01)
*H05B 1/02* (2006.01)
(Continued)

(52) U.S. Cl.
CPC ..... *A24F 40/51* (2020.01); *A24F 40/485* (2020.01); *H05B 1/0297* (2013.01); *A24F 40/10* (2020.01)

(58) Field of Classification Search
CPC ..... A24F 40/51; A24F 40/50; A24F 40/485; A24F 40/19; H05B 1/0297
(Continued)

(56) References Cited

U.S. PATENT DOCUMENTS

2013/0255702 A1* 10/2013 Griffith, Jr. ..... A24F 40/30 131/328
2014/0261488 A1 9/2014 Tucker
(Continued)

FOREIGN PATENT DOCUMENTS

CN 1700934 A 11/2005
CN 201199922 Y 3/2009
(Continued)

OTHER PUBLICATIONS

"Database WPI," Week 201633, Thomson Scientific, London, GB, May 6, 2016, 2 pages.
(Continued)

*Primary Examiner* — Harshad C Patel
(74) *Attorney, Agent, or Firm* — Patterson Thuente Pedersen, P.A.

(57) ABSTRACT

A device for controlling electrical power supply in response to air pressure measurement includes an airflow path, a chamber having an aperture, a liquid flow restrictor configured to inhibit ingress of liquid into the chamber via the aperture, a pressure sensor located in the chamber and operable to detect, in the presence of the liquid flow restrictor, air pressure changes caused by air flow in the airflow path, and a circuit for converting air pressure changes detected by the pressure sensor to control signals for controlling output of power from a battery.

20 Claims, 9 Drawing Sheets

(51) Int. Cl.
*A24F 40/485* (2020.01)
*A24F 40/10* (2020.01)

(58) Field of Classification Search
USPC ..... 131/329
See application file for complete search history.

(56) References Cited

U.S. PATENT DOCUMENTS

| | | | | |
|---|---|---|---|---|
| 2015/0157054 | A1 | 6/2015 | Liu | |
| 2015/0208728 | A1* | 7/2015 | Lord | A24F 7/00 131/329 |
| 2015/0245658 | A1 | 9/2015 | Worm et al. | |
| 2016/0128389 | A1 | 5/2016 | Lamb et al. | |
| 2016/0235120 | A1 | 8/2016 | Liu | |
| 2017/0224014 | A1* | 8/2017 | Fraser | H05B 1/0244 |
| 2017/0251725 | A1* | 9/2017 | Buchberger | H05B 1/0244 |
| 2018/0020733 | A1* | 1/2018 | Jochnowitz | A24F 40/485 131/329 |
| 2018/0168227 | A1* | 6/2018 | Fraser | A24F 40/465 |
| 2018/0184711 | A1* | 7/2018 | Dickens | A61M 11/042 |
| 2018/0184712 | A1* | 7/2018 | Fraser | A24F 40/465 |
| 2019/0150520 | A1* | 5/2019 | Fraser | A61M 11/042 |

FOREIGN PATENT DOCUMENTS

| | | | |
|---|---|---|---|
| CN | 201888252 | U | 7/2011 |
| CN | 102264420 | A | 11/2011 |
| CN | 203467675 | U | 3/2014 |
| CN | 203709256 | U | 7/2014 |
| CN | 104254356 | A | 12/2014 |
| CN | 204120221 | U | 1/2015 |
| CN | 204232297 | U | 4/2015 |
| CN | 204409583 | U | 6/2015 |
| CN | 204540819 | U | 8/2015 |
| CN | 204861187 | U | 12/2015 |
| CN | 105533811 | A | 5/2016 |
| CN | 105707981 | A | 6/2016 |
| CN | 107072307 | A | 8/2017 |
| EP | 3515217 | A1 | 7/2019 |
| GB | 2513639 | A | 11/2014 |
| GB | 2525294 | A | 10/2015 |
| GB | 2540135 | A | 1/2017 |
| JP | 2012506263 | A | 3/2012 |
| JP | 2019528696 | A | 10/2019 |
| RU | 115628 | U1 | 5/2012 |
| WO | WO2006013951 | | 2/2006 |
| WO | WO-2009037863 | A1 | 3/2009 |
| WO | WO2014179228 | | 11/2014 |
| WO | WO-2015149368 | A1 | 10/2015 |
| WO | WO-2016033418 | A1 | 3/2016 |
| WO | WO-2016065532 | A1 | 5/2016 |

OTHER PUBLICATIONS

International Preliminary Report on Patentability for Application No. PCT/GB2017/052655, dated Nov. 9, 2018, 18 pages.
International Search Report and Written Opinion for Application No. PCT/GB2017/052655, dated Dec. 14, 2017, 15 pages.
Office Action for Chinese Application No. 201780057946.3, dated Dec. 3, 24 pages.
Office Action dated Feb. 2, 2021 for Japanese Application No. 2019-510939, 5 pages.
Office Action dated Oct. 22, 2019 for Russian Application No. 2019108038, 6 pages.
Office Action dated May 26, 2020 for Japanese Application No. 2019-510939, 7 pages.
Search Report for GB Application No. GB1616036.8 dated Mar. 1, 2017, 4 pages.
Yu Hongiun, "Plastic products and processing for industrial parts," Feb. 28, 2003, pp. 12-15.
Zhu Donglai, "E-cigarette," Aug. 31, 2015, pp. 93-96.
Japanese Search Report, Application No. 2019-510939, dated Apr. 17, 2020, 48 pages.

* cited by examiner

DEVICE WITH LIQUID FLOW RESTRICTION

PRIORITY CLAIM

The present application is a National Phase entry of PCT Application No. PCT/GB2017/052655, filed Sep. 11, 2017, which claims priority from GB Patent Application No. 1616036.8, filed Sep. 21, 2016, which is hereby fully incorporated herein by reference.

TECHNICAL FIELD

The present disclosure relates to devices for controlling electrical power supply in response to air pressure measurement, for example for use in aerosol provision systems.

BACKGROUND

Aerosol provision systems such as e-cigarettes generally contain a reservoir of a source liquid containing a formulation, typically including nicotine, from which an aerosol is generated, such as through vaporization or other means. Thus an aerosol source for an aerosol provision system may comprise a heating element coupled to a portion of the source liquid from the reservoir. When a user inhales on the device, the heating element is activated to vaporize a small amount of the source liquid, which is thus converted to an aerosol for inhalation by the user. More particularly, such devices are usually provided with one or more air inlet holes located away from a mouthpiece of the system. When a user sucks on the mouthpiece, air is drawn through the inlet holes and past the aerosol source. There is an air flow path connecting the inlet holes to the aerosol source and on to an opening in the mouthpiece so that air drawn past the aerosol source continues along the flow path to the mouthpiece opening, carrying some of the aerosol from the aerosol source with it. The aerosol-carrying air exits the aerosol provision system through the mouthpiece opening for inhalation by the user.

To enable "on-demand" provision of the aerosol, in some systems the air flow path is also in communication with an air pressure sensor. Inhalation by the user through the air flow path causes a drop in air pressure. This is detected by the sensor, and an output signal from the sensor is used to generate a control signal for activating a battery housed in the aerosol provision system to supply electrical power to the heating element. Hence, the aerosol is formed by vaporization of the source liquid in response to user inhalation through the device. At the end of the puff, the air pressure changes again, to be detected by the sensor so that a control signal to stop the supply of electrical power is produced. In this way, the aerosol is generated only when required by the user.

In such a configuration the airflow path communicates with both the pressure sensor and the heating element, which is itself in fluid communication with the reservoir of source liquid. Hence there is the possibility that source liquid can find its way to the pressure sensor, for example if the e-cigarette is dropped, damaged or mistreated. Exposure of the pressure sensor to liquid can stop the sensor from operating properly, either temporarily or permanently.

Accordingly, approaches to mitigating this problem are of interest.

SUMMARY

According to a first aspect of certain embodiments described herein, there is provided a device for controlling electrical power supply in response to air pressure measurement, the device comprising: an airflow path; a chamber having an aperture; a liquid flow restrictor configured to inhibit ingress of liquid into the chamber via the aperture; a pressure sensor located in the chamber and operable to detect, in the presence of the liquid flow restrictor, air pressure changes caused by air flow in the airflow path; and a circuit for converting air pressure changes detected by the pressure sensor to control signals for controlling output of power from a battery.

The pressure sensor may be operable to detect, in the presence of the liquid flow restrictor, an air pressure change in the range of 155 Pa at an airflow in the airflow path of 5 ml per second to 1400 Pa at an airflow in the airflow path of 40 ml per second.

The airflow path may lie outside the chamber and be in communication with the aperture. With the exception of the aperture, the chamber may be airtight.

Alternatively, the aperture is an air outlet for the chamber, the chamber further comprises an air inlet, and the airflow path passes through the chamber and includes the aperture and the air inlet.

The liquid flow restrictor may be arranged in or across the aperture, or in or across the airflow path, or may be the aperture itself if appropriately sized.

The liquid flow restrictor may comprise a mesh, for example a mesh having a surface layer of hydrophobic material or is made from hydrophobic material, and/or a mesh having a pore size of 100 μm or less and a gauge of 200 or higher.

In other embodiments, the liquid flow restrictor may comprise a nozzle with a bore.

The nozzle may be made from or have a surface coating of hydrophobic material. For example, the nozzle may be made from polyether ether ketone. Alternatively, the nozzle may be hydrophilic. For example, the nozzle may be made from metal, such as stainless steel. The bore of the nozzle may have a diameter of 0.5 mm or less, such as 0.3 mm.

In other embodiments, the liquid flow restrictor may comprise a one-way valve configured to open under the pressure of air flow in the airflow path in a first direction and be closed against liquid flow in an opposite direction.

The device may further comprise a battery responsive to the control signals from the circuit. The device may be a component of an aerosol provision system.

According to a second aspect of certain embodiments provided herein, there is provided an aerosol provision system comprising a device for controlling electrical power supply in response to air pressure measurement according to the first aspect.

According to a third aspect of certain embodiments provided herein, there is provided a device for controlling electrical power supply in response to air pressure measurement, the device comprising: an airflow path; a chamber; an aperture opening from the airflow path into the chamber; a liquid flow restrictor arranged in or across the aperture and configured to inhibit ingress of liquid into the chamber through the aperture, the liquid flow restrictor comprising a mesh or a nozzle with a bore; a pressure sensor located in the chamber and operable to detect, in the presence of the liquid flow restrictor, air pressure changes caused by air flow in the airflow path; and a circuit for converting air pressure changes detected by the pressure sensor to control signals for controlling output of power from a battery.

According to a fourth aspect of certain embodiments provided herein, there is provided a device for controlling electrical power supply in response to air pressure measurement, the device comprising: an airflow path; a chamber; an aperture opening from the airflow path into the chamber; a liquid flow restrictor arranged in or across the aperture and configured to be permeable to air and impermeable to the liquid so as to inhibit ingress of liquid into the chamber; a pressure sensor located in the chamber and operable to detect, in the presence of the liquid flow restrictor, air pressure changes caused by air flow in the airflow path; and a circuit for converting air pressure changes detected by the pressure sensor to control signals for controlling output of power from a battery.

These and further aspects of certain embodiments are set out in the appended independent and dependent claims. It will be appreciated that features of the dependent claims may be combined with each other and features of the independent claims in combinations other than those explicitly set out in the claims. Furthermore, the approach described herein is not restricted to specific embodiments such as set out below, but includes and contemplates any appropriate combinations of features presented herein. For example, a device may be provided in accordance with approaches described herein which includes any one or more of the various features described below as appropriate.

BRIEF DESCRIPTION OF THE DRAWINGS

Various embodiments will now be described in detail by way of example only with reference to the accompanying drawings in which.

DETAILED DESCRIPTION

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

As described above, the present disclosure relates to (but is not limited to) aerosol provision systems, such as e-cigarettes. Throughout the following description the term "e-cigarette" may sometimes be used; however, it will be appreciated this term may be used interchangeably with aerosol (vapor) provision system.

Figure 1:
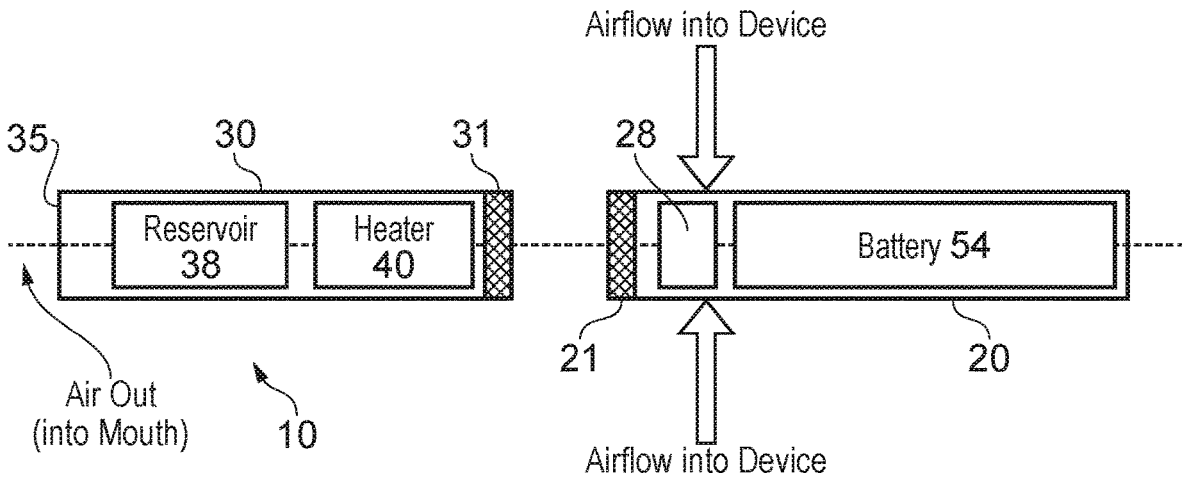
FIG. 1 shows a schematic representation of an aerosol provision system in which embodiments of the disclosure may be used.

FIG. 1 is a highly schematic diagram (not to scale) of an aerosol/vapor provision system such as an e-cigarette 10 to which some embodiments are applicable. The e-cigarette has a generally cylindrical shape, extending along a longitudinal axis indicated by dashed line, and comprises two main components, namely a body 20 and a cartridge assembly 30.

The cartridge assembly 30 includes a reservoir 38 containing a source liquid comprising a liquid formulation from which an aerosol is to be generated, for example containing nicotine, and a heating element or heater 40 for heating source liquid to generate the aerosol. The source liquid and the heating element 40 may be collectively referred to as an aerosol source. The cartridge assembly 30 further includes a mouthpiece 35 having an opening through which a user may inhale the aerosol generated by the heating element 40. The source liquid may comprise around 1 to 3% nicotine and 50% glycerol, with the remainder comprising roughly equal measures of water and propylene glycol, and possibly also comprising other components, such as flavorings. The body 20 includes a re-chargeable cell or battery 54 (referred to herein after as a battery) to provide power for the e-cigarette 10, and a printed circuit board (PCB) 28 and/or other electronics for generally controlling the e-cigarette. In use, when the heating element 40 receives power from the battery 54, as controlled by the circuit board 28 in response to pressure changes detected by an air pressure sensor (not shown), the heating element 40 vaporizes source liquid at the heating location to generate the aerosol, and this is then inhaled by a user through the opening in the mouthpiece 35. The aerosol is carried from the aerosol source to the mouthpiece 35 along an air channel (not shown) that connects the aerosol source to the mouthpiece opening as a user inhales on the mouthpiece.

In this particular example, the body 20 and cartridge assembly 30 are detachable from one another by separation in a direction parallel to the longitudinal axis, as shown in FIG. 1, but are joined together when the device 10 is in use by cooperating engagement elements 21, 31 (for example, a screw or bayonet fitting) to provide mechanical and electrical connectivity between the body 20 and the cartridge assembly 30. An electrical connector interface on the body 20 used to connect to the cartridge assembly 30 may also serve as an interface for connecting the body 20 to a charging device (not shown) when the body 20 is detached from the cartridge assembly 30. The other end of the charging device can be plugged into an external power supply, for example a USB socket, to charge or to re-charge the battery 54 in the body 20 of the e-cigarette. In other implementations, a separate charging interface may be provided, for example so the battery 54 can be charged when still connected to the cartridge assembly 30.

The e-cigarette 10 is provided with one or more holes (not shown in FIG. 1) for air inlet. These holes, which are in an outer wall of the body 20, connect to an airflow path through the e-cigarette 10 to the mouthpiece 35. The air flow path includes a pressure sensing region (not shown in FIG. 1) in the body 20, and then connects from the body 20 into cartridge assembly 30 to a region around the heating element 40 so that when a user inhales through the mouthpiece 35, air is drawn into the airflow path through the one or more air inlet holes. This airflow (or the resulting change in pressure) is detected by a pressure sensor (not shown in FIG. 1) in communication with the airflow path that in turn activates the heating element (via operation of the circuit board 28) to vaporize a portion of the source liquid to generate the aerosol. The airflow passes through the airflow path, and combines with the vapor in the region around the heating element 40 and the resulting aerosol (combination of airflow and condensed vapor) travels along the airflow path connecting from the region of the heating element 40 to the mouthpiece 35 to be inhaled by a user.

In some examples, the detachable cartridge assembly 30 may be disposed of when the supply of source liquid is exhausted, and replaced with another cartridge assembly if so desired. The body 20, however, may be intended to be reusable, for example to provide operation for a year or more by connection to a series of disposable detachable cartridges assemblies. It is therefore of interest that the functionality of the components in the body 20 be preserved.

Figure 2:
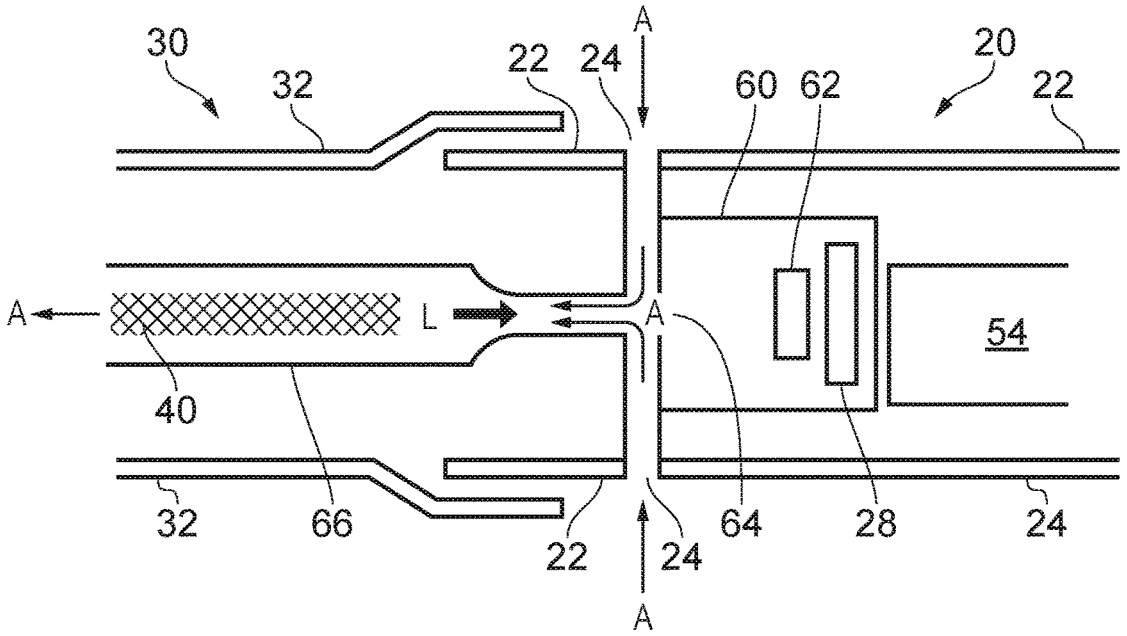
FIG. 2 shows a cross-sectional schematic representation of part of an aerosol provision system in which embodiments of the disclosure may be used.

FIG. 2 shows a schematic longitudinal cross-sectional view through a middle part of an example e-cigarette similar to that of FIG. 1, where the cartridge assembly 30 and the body 20 join. In this illustration, the cartridge assembly 30 is shown attached to the body 20; the side walls 32, 22 of these components being shaped to allow a push fit (snap fit, bayonet or screw fittings may also be used). The side wall 22 of the body 24 has a pair of holes 24 (more or fewer holes may be employed) which allow the inlet of air, shown by the arrows A. The holes connect to a first part of a central air flow path or channel 66 located in the body 20, which is joined to a second part of the air flow channel 66 located in the cartridge assembly 30 when the cartridge assembly 30 and the body 20 are connected, to form a continuous air flow channel 66. The heating element 40 is located within the air flow channel 66 so that air can be drawn across it to collect vaporized source liquid when a user inhales through the mouthpiece to pull air in through the holes 24.

The body 20 also includes a pressure sensor 62 operable to detect changes in air pressure within the airflow channel 66. The sensor 62 is in a chamber 60 which connects to the first part of the airflow path 66 via an aperture 64. Changes in air pressure in the channel 66 are communicated into the chamber 60 through the aperture 64 for detection by the sensor 62. In alternative arrangements, the sensor 62 can be located within the airflow channel (discussed further below). The circuit board 28 or other electronics previously mentioned is also located in the chamber 60 in this example (it may be situated elsewhere in the e-cigarette), and receives the output of the sensor 62 as it responds to changing air pressure. If an air pressure drop exceeding a predetermined threshold is detected, this indicates that a user is inhaling through the airflow channel, and the circuit board generates a control signal for the battery 54 to supply electrical current to produce heating of the heating element. These various components may be considered as a device for controlling electrical power supply in response to air pressure measurement.

The heating element 40 receives a supply of source liquid from the e-cigarette's reservoir (not shown in FIG. 2), for example by wicking (depending on the material structure of the heating element). As can be appreciated from FIG. 2, this brings the source liquid into close proximity to the pressure sensor. Under normal operating conditions, this will generally not be problematic; the heating element is able to retain the source liquid, and the source liquid is regularly drawn away from the area as it is vaporized. However, a leak, breakage or other failure of the reservoir, an impact on the e-cigarette, or similar incident, can force or enable source liquid to travel along the airflow channel 66 past the heating element 40 in an opposite direction to the inhalation airflow direction, as indicated by the arrow L. The liquid may then be able to enter the chamber 60 and disrupt operation of the pressure sensor 62.

Embodiments of the disclosure relate to arrangements intended to inhibit exposure of the pressure sensor to source liquid while still permitting acceptable operation of the pressure sensor. Several configurations are considered.

Device Geometries

Figure 3:
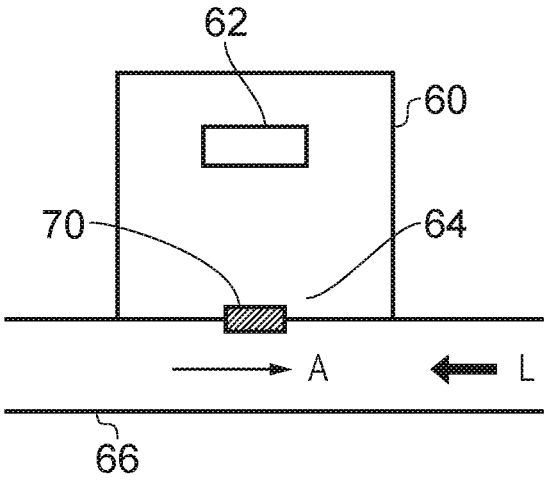
FIG. 3 shows a first example configuration of a device according to embodiments of the disclosure.

FIG. 3 shows a highly schematic representation (not to scale) of a first example air pressure detection arrangement according to embodiments of the disclosure. The arrangement is similar to that shown in FIG. 2. No significance attaches to the orientation of the features as variously illustrated. In the FIG. 3 example, the pressure sensor 62 is located in a chamber 60 adjacent to part of the airflow path or channel 66, which is defined by side walls formed within the structure of the e-cigarette and in communication with the air inlet holes described previously. The channel may or may not be straight as it passes the chamber. Upon inhalation by a user, air flows along the path as indicated by the arrow A. The chamber 60 has an aperture 64 in one wall which opens into the air flow path 66, the airflow path being outside the chamber and not flowing through it. Changes in air pressure occurring in the airflow path are communicated to the interior of the chamber 60 through the aperture 64, so that the pressure sensor 62 is able to detect the changes, and send [[an]] a corresponding output to the controlling electronics or circuit board (not shown in FIG. 3). In accordance with embodiments of the invention, the device further includes a liquid flow restrictor 70 (also referred to as a restrictor) positioned in, over or across the aperture 64 which acts to prevent, reduce or inhibit any liquid L which might be in the airflow path 66 from entering the chamber 60 and compromising the sensor 62. Various configurations of liquid flow restrictor 70 are contemplated; these are described further below. However, common properties of the configurations are that each device is permeable to air flow to the extent that pressure changes in the airflow path 66 are wholly or largely communicated into the chamber 60 for successful detection by the sensor 66, whilst also being wholly or significantly impermeable to liquid flow so that ingress of liquid into the chamber 60 and the vicinity of the sensor 66 is inhibited or prevented. To this end, in this example the liquid flow restrictor 70 will typically be sized and shaped to fill the aperture 64, either by being inserted into the aperture or secured over the aperture 64. In the particular arrangement of the FIG. 3 example, operation of the liquid flow restrictor 70 is facilitated if the chamber 60 is made substantially airtight except for the aperture. This creates a back pressure from the chamber 60 as compared to the pressure in the airflow channel during an inhalation puff which acts against the flow of any liquid on or near the restrictor 70 into the chamber 60. Also, the FIG. 3 arrangement maintains the airflow channel in a clear and unrestricted condition so that the user experience of inhaling through the e-cigarette is unaltered. The airflow A bypasses the restrictor 70. Additionally, the configuration of the FIG. 3 example offers an alternative and easier flow path for any liquid that finds its way as far along the airflow path as the aperture. Liquid is more easily able to continue along the airflow path past the aperture than to penetrate the restrictor and enter the chamber, so this is the more likely outcome, and liquid is kept out of the chamber by this mechanism also.

Figure 4:
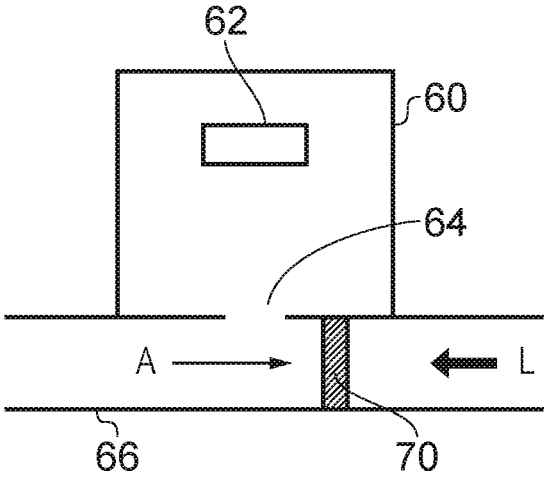
FIG. 4 shows a second example configuration of a device according to embodiments of the disclosure.

FIG. 4 shows a highly schematic representation (not to scale) of a second example air pressure detection arrangement according to embodiments of the disclosure. The chamber 60, sensor 62, aperture 64 and airflow path 66 are arranged as in the FIG. 3 example, with the airflow path 66 external to the chamber 60. In this example, however, the liquid flow restrictor 70 is situated in and extends across the airflow path 66, rather than in the aperture 64. It is located downstream from the aperture having regard to the direction of inhalation airflow A, but upstream from the aperture having regard to the direction of possible liquid flow L. Thus, air pressure in the airflow path 66 is communicated directly into the chamber 60 and to the sensor 62 via the aperture without any impediment, while liquid is inhibited or prevented from reaching the aperture by the presence of the restrictor 70. As before, the restrictor 70 is permeable to airflow so that air can pass freely along the airflow path 66. Note that in this example, however, the restrictor 70 sits directly in the airflow A along the path 66; it is in a flow-through configuration, in contrast to the flow-bypass configuration of FIG. 3. The presence of the restrictor may therefore be apparent to a user inhaling through the e-cigarette, for example the inhalation draw pressure required to activate the device might increase. The restrictor can be designed to address this issue, as discussed further below.

Figure 5:
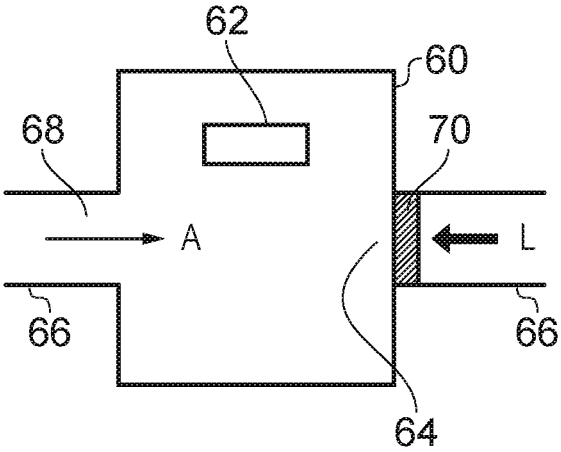
FIG. 5 shows a third example configuration of a device according to embodiments of the disclosure.

FIG. 5 shows a highly schematic representation (not to scale) of a third example air pressure detection arrangement according to embodiments of the invention. This example has similarities to the FIG. 4 example in that it is a flow-through arrangement, where the airflow A passes through the restrictor 70. In contrast with both the FIG. 3 and FIG. 4 examples, however, the airflow path 66 is arranged to pass through the chamber 60. The chamber 60 has an aperture 64 as before, but in this example the aperture 64 is an outlet or opening from the chamber 60 for the airflow path 66. The chamber 60 has a further opening 68, being an inlet into the chamber 60 for the airflow path 66. During user inhalation, the airflow A enters the chamber 60 through the inlet 68 and leaves through the outlet aperture 64. The pressure sensor 62 is located in the chamber 60 as before, but the FIG. 5 configuration exposes the sensor 62 more directly to the airflow and resulting pressure changes. The chamber 60 is illustrated as a box substantially broader than the inlet and outlet portions of the airflow path; this is not required. A widening of the path sufficient only to accommodate the volume of the sensor might be used instead, or the sensor might be located directly in the airflow path so that the path acts as the chamber. The chamber might be shaped to facilitate smooth airflow therethrough. In this example, the liquid flow restrictor 70 is positioned in or across the aperture 64, at the air outlet from the chamber. This location is upstream from the sensor 62 having regard to the direction of possible liquid flow L, so the sensor 62 is protected from exposure to liquid by the liquid flow inhibiting character of the restrictor 70. The restrictor 70 can be configured for minimal impact on the airflow passing through it so that its presence is not readily detectable by the inhaling user.

Although the examples of FIGS. 3, 4 and 5 differ in the relative positioning of the components and features, it will be appreciated that in each case the restrictor is arranged to keep fluid from the sensor by inhibiting liquid ingress into the chamber through an aperture in the chamber, while not impeding the functioning of the sensor.

Three designs of liquid flow restrictor will now be described. Respectively, these are a mesh restrictor, a nozzle restrictor, and a valve restrictor.

Mesh Restrictor

A mesh sheet can be employed as a liquid flow restrictor in the present context. The openings or pores between the warp and weft of the mesh allow air to flow through, but if the openings are sufficiently small the passage of liquid can be greatly impeded owing to surface tension in the liquid. The liquid will be unable to form into sufficiently small droplets to pass through the openings. The mesh can be thought of as a membrane which is permeable to gas (including air) but impermeable to liquid. The impermeability to liquid can be enhanced if the mesh is provided with a surface layer of a hydrophobic material, or fabricated from a hydrophobic material. A sheet of appropriately sized and/or treated mesh can be affixed in place to wholly or substantially cover the chamber's aperture 64 (FIGS. 3 and 5 examples) or to extend wholly or substantially across the bore of the airflow channel 66 (FIG. 4 example, or FIG. 5 example in a more upstream location than depicted).

Possible mesh materials include stainless steel and polymer (such as nylon). Testing of several fine meshes has been conducted. In each case, the mesh was formed from a regular array of fibers or wires woven into a square grid pattern. Different wire thicknesses and different gauges (giving different pore sizes) were tested, including 80 gauge stainless steel mesh (pore size about 280 μm, wire thickness about 150 μm); 200 gauge stainless steel mesh (pore size about 64 μm, wire thickness about 30 μm); 400 gauge stainless steel mesh (pore size about 37 μm, wire thickness about 27 μm); 500 gauge stainless steel mesh (pore size about 22 μm, wire thickness about 28 μm); and fine nylon mesh (pore size about 162 μm, wire thickness about 53 μm). Samples of each mesh type were treated with a spray application hydrophobic treatment, a commercially available example product being NeverWet® from Rust-Oleum® which repels surface liquid. Vapor deposition is an application technique for hydrophobic treatment. Also, selection of a suitable hydrophobic material should be made having regard to the intended purpose of the device. Inclusion in an aerosol provision system intended for oral use by humans would require that the hydrophobic material be tested or certified for food and/or medical industry use.

The meshes were tested in test rigs with both flow-through and flow-bypass configurations, with chamber and airflow passage geometries comparable to those found in actual e-cigarettes. A vacuum pump was used to generate airflow through the test rig, monitored with a flow meter and manometer. To mimic flow conditions within an actual e-cigarette device, an air flow of 50 ml/s achieved with a total pressure drop of approximately 1.3 kPa was produced. The airflow ran for a period of approximately 3 seconds.

The test rig included two pressure sensors, one on each side of the mesh to measure the pressure drop across the mesh. The measurements can be assessed to determine whether the presence of the mesh adversely affects the pressure change in the chamber so that a measurement made in the chamber would not properly reflect the airflow during an inhalation, and whether the presence of the mesh is interfering too much with airflow through the device.

Figure 6:
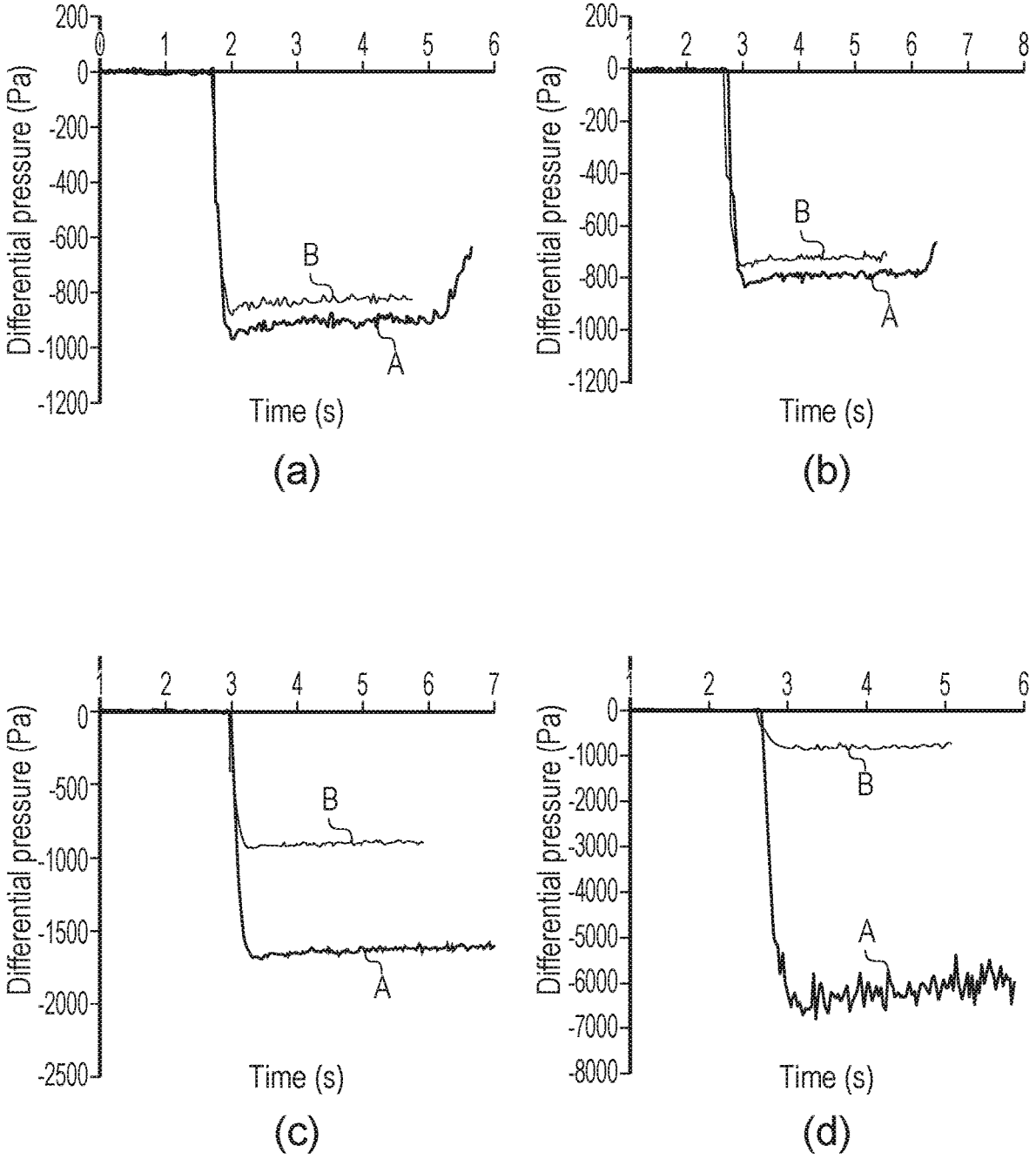
FIG. 6 shows graphs of pressure measurements recorded using a mesh embodiment of a liquid flow restrictor in a flow-through configuration.

FIG. 6 shows experimental results from the test rig for a flow-through configuration, as plots of measured differential pressure. The lines A are from a sensor on the upstream side of the mesh and the lines B are from a sensor on the downstream side of the mesh. The data is normalized about the value of atmospheric pressure so that only differential pressure relative to atmosphere is shown. FIG. 6(*a*) shows measurements from a control test, with a 2 mm diameter open aperture and no mesh. This result indicates a pressure drop of about 0.1 kPa across the aperture at a flow rate of 50 ml/s. FIG. 6(*b*) shows measurements from a test of an aperture of 5 mm diameter covered with the 80 gauge steel mesh with hydrophobic coating. A similar pressure drop of about 0.1 kPa is observed, indicating that the presence of the mesh does not affect the airflow and pressure behavior. In contrast, for smaller gauge meshes the pressure drop required to maintain the 50 ml/s flow rate becomes much greater. FIG. 6(*c*) shows measurements for the 200 gauge steel mesh with hydrophobic coating (5 mm diameter), indicating a pressure drop of about 0.7 kPa, and FIG. 6(*d*) shows measurements for the 400 gauge steel mesh with hydrophobic coating (5 mm diameter) and indicates a pressure drop of about 6 kPa. The finer meshes are therefore contributing a high resistance to airflow, which would likely be considered to give too great a draw resistance in an actual aerosol provision system.

It may be that the high resistance of the finer meshes was partly caused by clogging of the pores by the applied hydrophobic spray coating. For some applications, this may not be problematic. Otherwise, it is possible to adopt a coating process that applies a thinner layer of hydrophobic material, or to omit the hydrophobic material, or to increase the diameter of the aperture and the mesh covering it (options for this will depend on the desired geometry of the device), or to use mesh with larger pores if it can still give suitable restriction to liquid flow.

Figure 7:
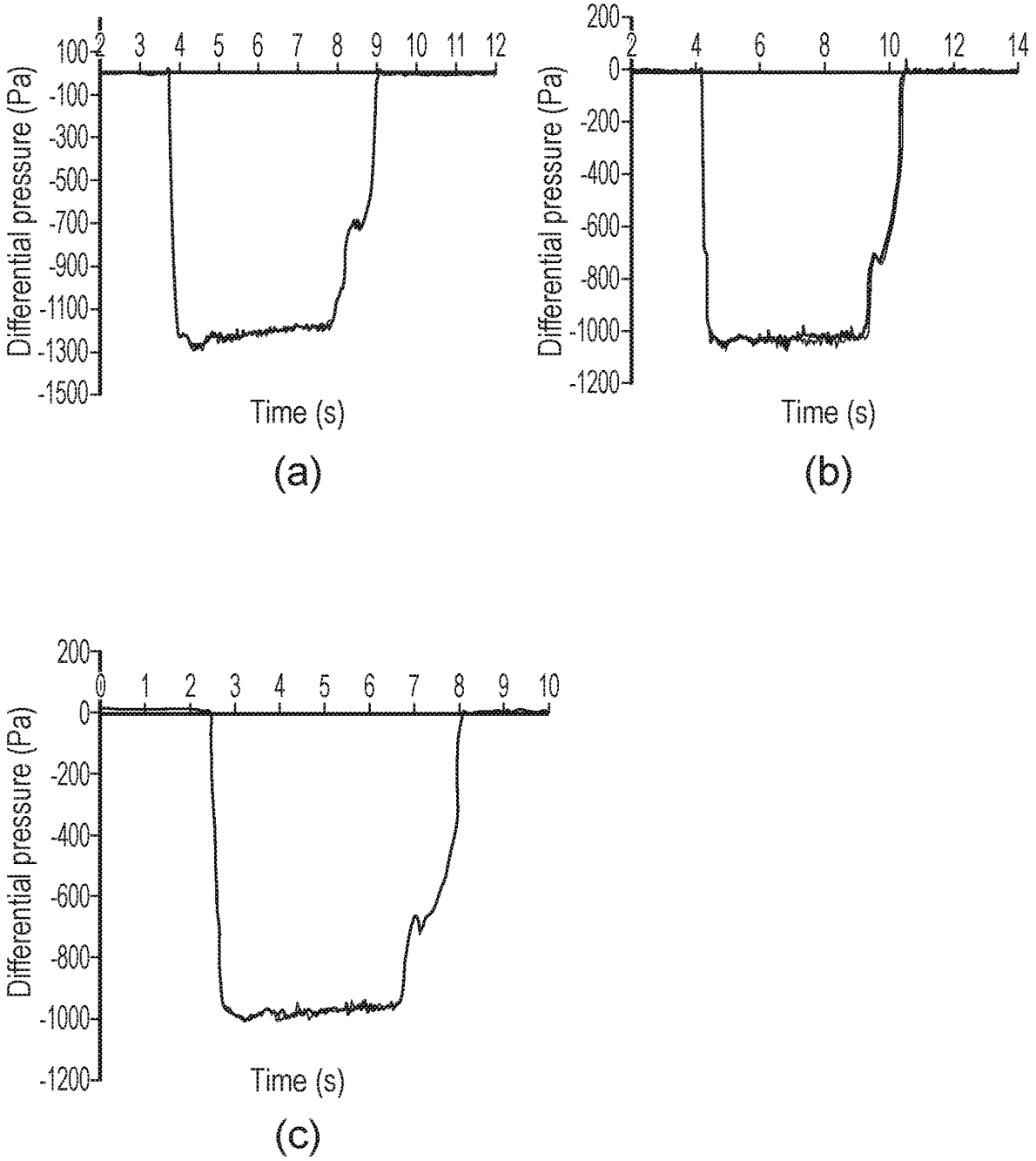
FIG. 7 shows graphs of pressure measurements recorded using a mesh embodiment of a liquid flow restrictor in a flow-bypass configuration.

FIG. 7 shows experimental results from the test rig for a flow-bypass configuration with a mesh restrictor. In this arrangement, a first sensor was in a closed chamber behind an aperture covered by mesh, and a second sensor was in the main airflow passage. The first sensor therefore measures the pressure drop in the passage as experienced through the mesh. FIG. 7(*a*) shows measurements from a control test, with a 10 mm open aperture and no mesh. Measurements from both sensors are plotted, but are substantially overlapping, indicating the same pressure both inside and outside the chamber, with little or no decrease in magnitude or time delay. Similar results are observed for a 10 mm diameter 500 gauge steel mesh (no hydrophobic coating) and for a 10 mm diameter polymer mesh (no hydrophobic coating), shown in FIGS. 7(*b*) and 7(*c*) respectively. These results indicate that a pressure sensor in a separate chamber communicating by an aperture with the airflow path and protected by a mesh over the aperture is able to accurately detect pressure changes within the flow path, and the mesh does not interfere with airflow along the path. An advantage of this geometry (corresponding to the FIG. 3 example) is that because the restrictor device, in the form of a mesh, is not placed in the airflow path, a much finer mesh can be used without any increase in the draw resistance, compared to a flow-through geometry. A finer mesh will likely be more effective at resisting liquid flow and hence preventing liquid ingress into the chamber, and may provide adequate protection without hydrophobic coating.

The various meshes, with and without hydrophobic coating, were further tested to assess their ability to resist seepage of liquid therethrough. Using tubes closed at a bottom end with a disc of each mesh type, various seepage tests were carried out, of increasing rigor. The liquid used was a nicotine solution for use in e-cigarettes. The untreated polymer mesh and the untreated 80 gauge steel mesh withstood one drop of liquid added plus a minor agitation without seepage. The addition of further drops caused seepage. When treated with hydrophobic coating these meshes were initially able to withstand a further five drops, but showed seepage after a 10 minute delay. This was also true of all the finer gauge steel meshes when lacking hydrophobic treatment. When given a hydrophobic coating the 200, 400 and 500 gauge steel meshes showed no seepage after the 10 minute delay, but did allow liquid through when subjected to 1.3 kPa positive pressure, which was able to push the liquid through the mesh pores. This applied pressure corresponds to a user actively blowing into an e-cigarette (as opposed to the usual sucking, inhalation action), which might be done in an attempt to clear a perceived blockage. Such a blockage might be a leak of source liquid from the reservoir, so that blowing into the e-cigarette might propel liquid through any mesh barrier placed across the airflow path. In this context, therefore, a flow-bypass geometry such as the FIG. 3 example might be preferred. Results of further tests are relevant to this.

Figure 8:
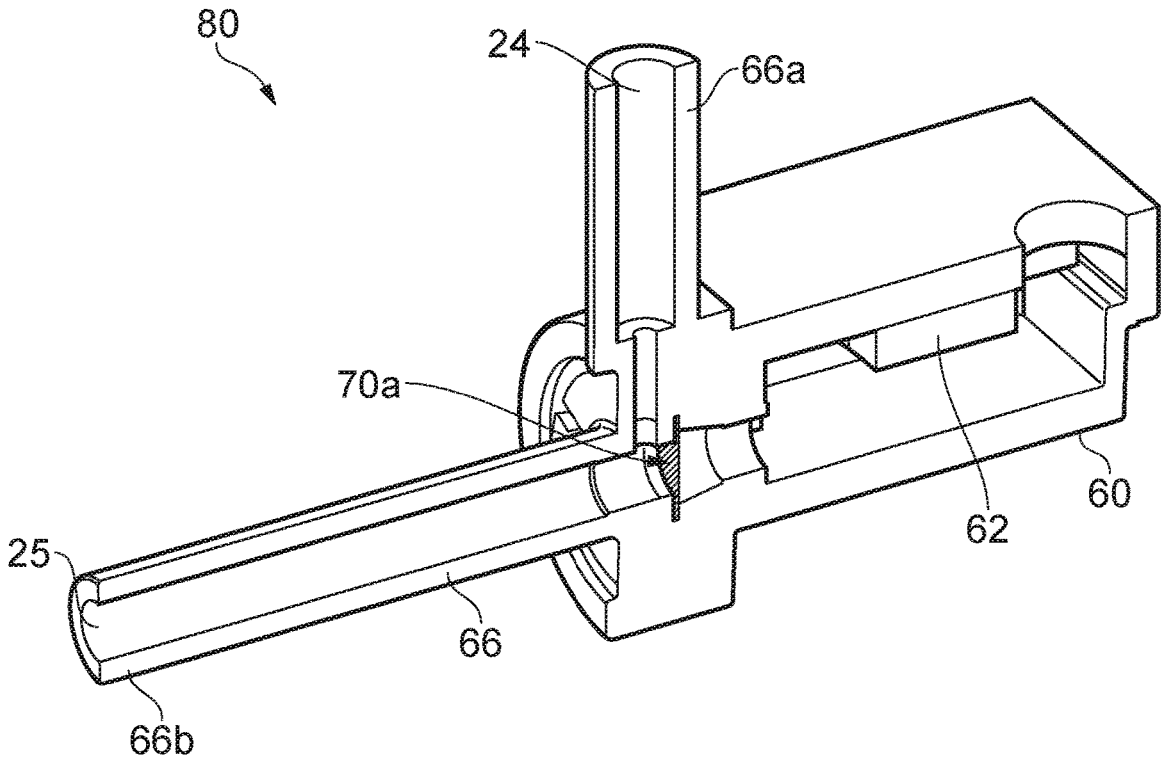
FIG. 8 shows a perspective cross-sectional view of an example device in accordance with a mesh embodiment of a liquid flow restrictor.

FIG. 8 shows a cross-sectional perspective view through a further test rig 80, designed to more accurately model parts of an e-cigarette, and using a mesh restrictor in a flow-bypass configuration, as can be appreciated by a comparison with FIG. 2. A chamber 60 has mounted on its upper interior surface a pressure sensor 62. The upper wall of the chamber 60 is illustrated with a hole; this was used in tests regarding air leaks and air-tightness, but was closed for the current example to give an air-tight chamber. The chamber 60 has an aperture of diameter 4 mm in one wall, which is covered by a mesh restrictor 70*a*. The mesh in this example was a 5 mm diameter disc of 500 gauge stainless steel with hydrophobic surface coating, glued over the aperture. An air flow path 66 runs past the aperture so that the chamber interior is in air communication with the air flow path 66 via the mesh 70*a*. The path is formed from a first tube 66*a* arranged vertically to simulate the air inlet through hole 24 in the body of an e-cigarette, and a second tube 66*b* arranged horizontally to simulate the airflow channel leading to the heating element in the cartridge assembly of an e-cigarette, but in the test rig 80 ending in an outlet 25. The two tubes join at a right angle in the vicinity of the mesh 70*a* and aperture.

To simulate a leak and an unblocking attempt by a user, the test rig 80 was rotated to place the tube 66*b* vertically, and this tube 66*b* was flooded with nicotine solution (the same liquid as used in the seepage tests). This equates to an extreme leak caused by total failure of the cartridge assembly. A positive pressure was applied to the outlet 25 to mimic a user blowing into a blocked e-cigarette; this propelled the nicotine solution along the tube 66*a* and out through the air inlet 24. Then, pressure measurements were recorded during a 3 second 50 ml/s airflow (as before) and compared with measurements under the same condition made before the leak simulation.

Figure 9:
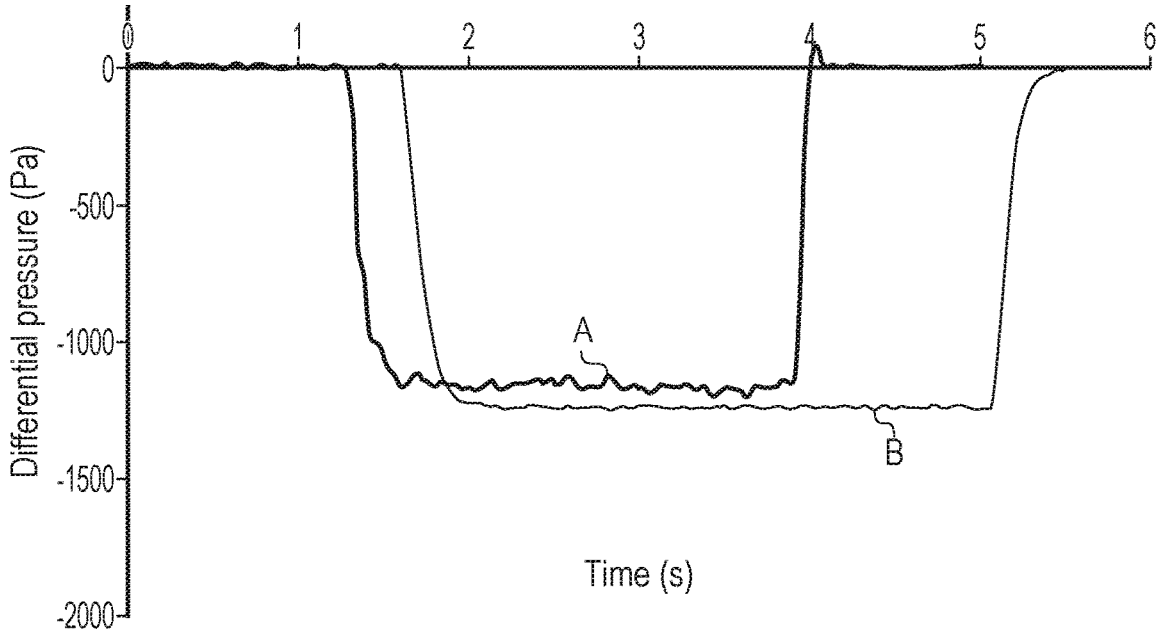
FIG. 9 shows a graph of pressure measurements recorded from the device of FIG. 8 before and after leak testing.

FIG. 9 shows a graph of these measurements, normalized to atmospheric pressure as before. Line A and line B are respectively the recorded pressure signal before and after the leak simulation. As can be seen, the two recorded pressure profiles are very similar, indicating that the mesh was successful in protecting the sensor from liquid in this by-pass arrangement (which provides an alternative path for the liquid, rather than it being forced through the mesh), and also that any residual liquid in and around the mesh does not adversely affect the pressure transferred into the chamber and detected by the sensor.

For the particular application of an aerosol provision system such as an e-cigarette, the results indicate that a mesh with a pore size of about 25 μm or less at a gauge of about 500 would be effective. Larger pores and gauges may also be considered adequate for this application, such as a pore size of less than 100 μm, less than 75 μm or less than 50 μm, at a gauge of 200 or 400. For other applications, meshes of other dimensions may be preferred.

Nozzle Restrictor

A second example of a liquid flow restrictor that may be employed is a nozzle, or tube, by which is meant an element having a narrow bore, possibly cylindrical, passing therethrough. The bore may be straight, which reduces the impact of the presence of the nozzle on transmission of the air pressure change through the restrictor to the sensor. Also, the bore may have a constant or substantially constant diameter, width and/or cross-sectional area. When placed in an aperture or airflow path as in the configurations of FIGS. 3, 4 and 5, the nozzle has the effect of reducing or narrowing the width or diameter of the aperture or path right down to the width of the bore. Alternatively, the aperture or path might be formed with a narrow diameter (the bore) at the appropriate point to avoid the need for a separate component. Air can still pass through the bore, but the passage of liquid will be greatly restricted; surface tension will prevent the liquid forming droplets small enough to pass through the bore. Any positive pressure on the far side of the nozzle, for example from within a sealed chamber, will also resist the flow of liquid. Hence, a barrier is formed which is permeable to air but impermeable or near-impermeable to liquid, which can be placed to protect the sensor from exposure to liquid. In the context of a flow-through geometry (FIGS. 4 and 5, for example), the nozzle may restrict the flow of air too much for a particular application, although it may sometimes be useful. In such a case, a nozzle might more usefully be employed in a flow-bypass geometry, such as the FIG. 3 configuration.

Various nozzles were tested in flow-bypass test rig similar to that used for the mesh testing, with a first sensor located inside a chamber having a narrow bore hole as an aperture, and a second sensor located in an airflow path outside the chamber. As before, a vacuum pump was applied to the rig for periods of about three seconds, producing a flow rate of about 50 ml/s.

Figure 10:
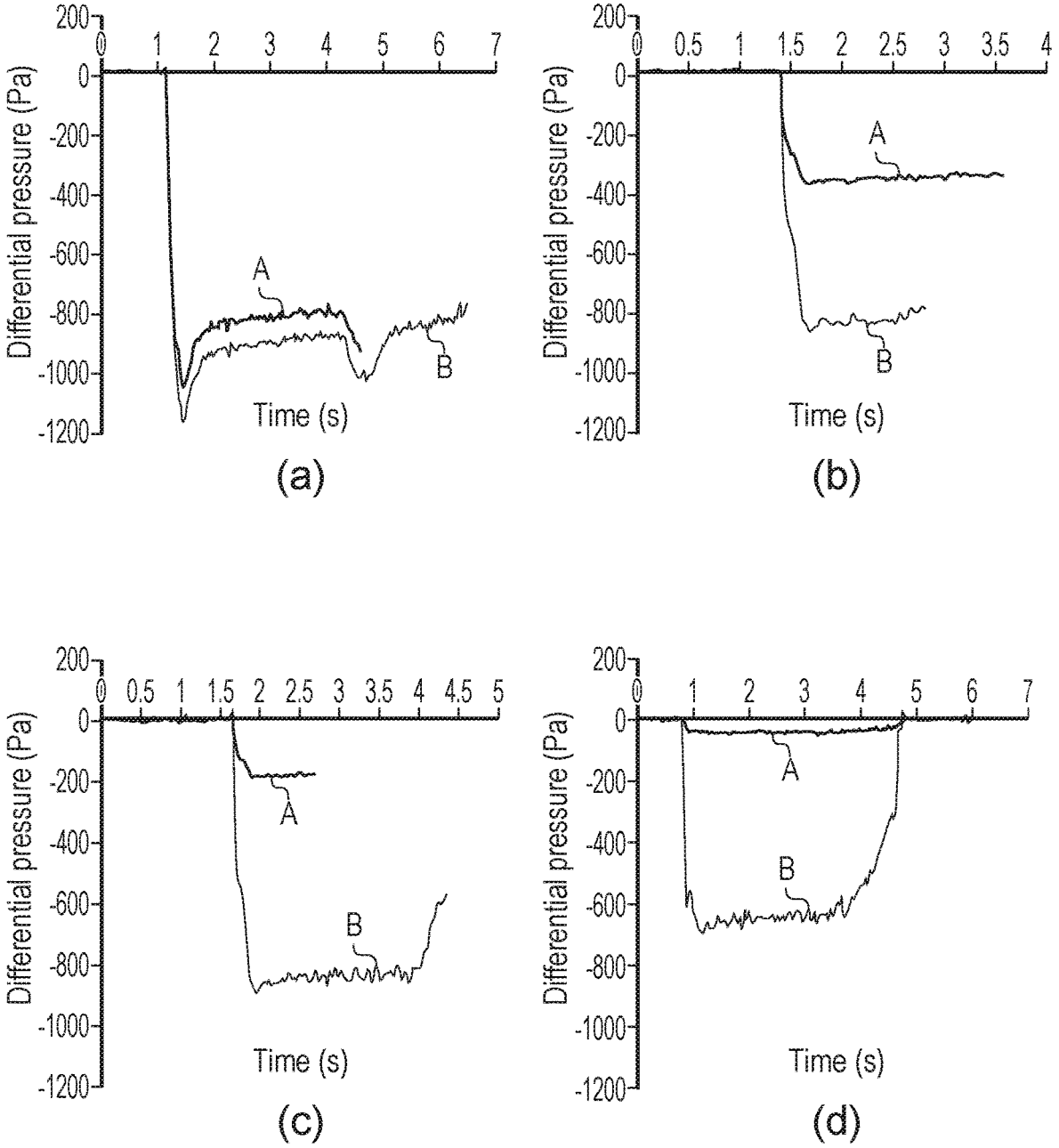
FIG. 10 shows graphs of pressure measurements recorded using a nozzle embodiment of a liquid flow restrictor in a flow-bypass configuration.

FIG. 10 shows the results of these tests, as plots of the measurements recorded by the two sensors, normalized to atmospheric pressure as before. The lines A are from the sensor in the chamber and hence behind the nozzle, and the lines B are from the sensor in the airflow path. FIG. 8(*a*) show measurements for a 1.2 mm internal diameter hole or bore, FIG. 8(*b*) shows measurements for a 0.51 mm internal diameter hole or bore, FIG. 8(*c*) shows measurements for a 0.26 mm internal diameter hole or bore and FIG. 8(*d*) shows measurements for a 0.21 mm internal diameter hole or bore. Assessment of these results reveals how much of the external pressure (air flow in the airflow path) is transmitted through the nozzle bore and detected by the sensor in the chamber (lines A). For the largest, 1.2 mm, nozzle, approximately 90% of the external signal is detected. The proportion of signal detected inside the chamber decreases with decreasing nozzle bore, until with the 0.21 mm nozzle only about 10% of the external airflow pressure is detected. This is not wholly as expected; the reduction in signal is greater than anticipated. A likely explanation is that there were imperfections in the manufacture and assembly of the rig so that the chamber containing the sensor was not fully sealed against the external atmosphere. As nozzle size decreases the effect of any leaks will become proportionally larger and produce equalization of the pressure in the chamber to atmosphere; this will mask a low pressure signal generated by airflow on the other side of the nozzle (in the airflow path). Ensuring a good seal against atmospheric pressure for a chamber housing a sensor and shielded by a small bore nozzle will overcome this. This is also true of embodiments using a mesh restrictor instead of a nozzle restrictor. High quality manufacturing and testing to achieve a sealed chamber can provide larger measured signals from within the chamber, and hence more reliable device operation. Further testing verified this.

Figure 11:
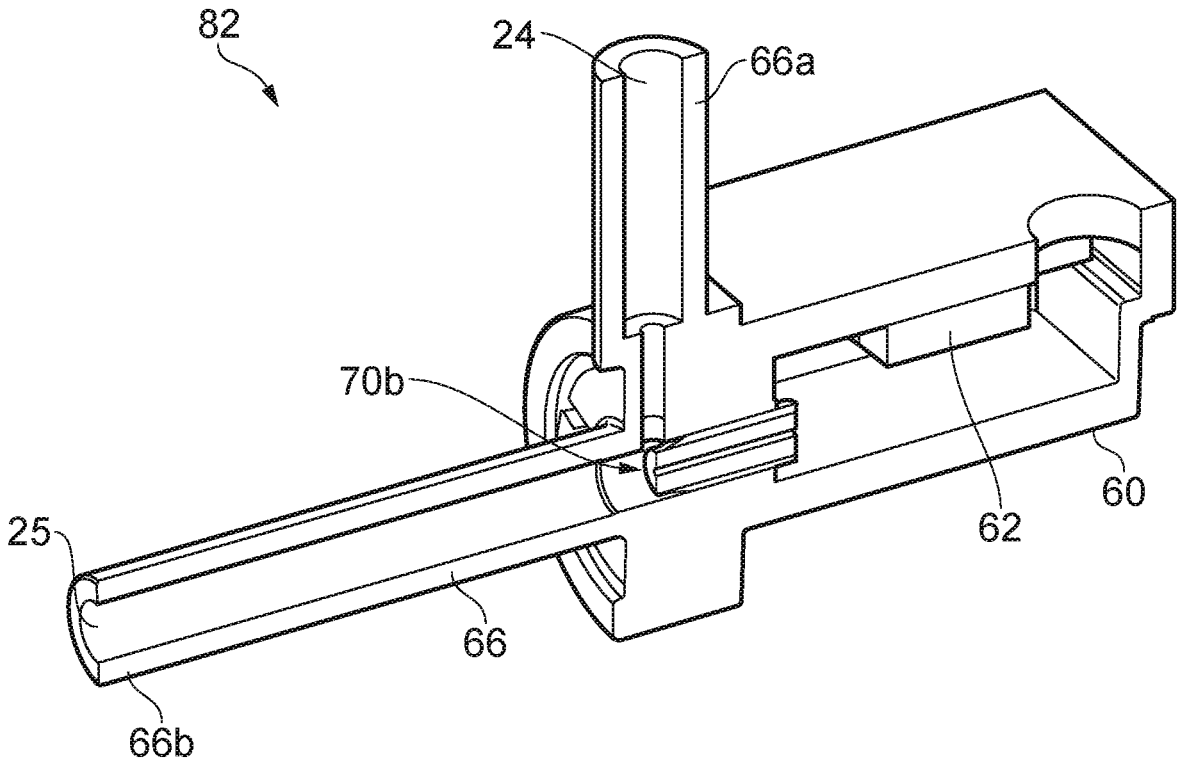
FIG. 11 shows a perspective cross-sectional view of an example device in accordance with a nozzle embodiment of a liquid flow restrictor.

FIG. 11 shows a perspective cross-sectional view through a further test rig built to test nozzle restrictors. The rig 82 has a construction the same as that of the mesh test rig 80 shown in FIG. 8, except that the mesh restrictor 70*a* is replaced with a nozzle restrictor 70*b*. Various nozzles were tested, each filling the aperture into the chamber 60. The nozzles had inner bore diameters of 0.5 mm, 0.25 mm and 0.125 mm. Other inner bore diameters can be used, such as 0.4 mm, 0.3 mm, 0.2 mm and 0.1 mm. The nozzles were made from polyether ether ketone (PEEK), which is an inherently hydrophobic material. Other hydrophobic materials might also be used to manufacture nozzles for restrictor applications. Metals can also be used to manufacture the nozzle, such as stainless steel. Further, the chamber can be formed with an integrated nozzle. For example, the chamber can be formed with an aperture which is suitably sized so as to function as a nozzle restrictor. The chamber was sealed to make it airtight expect for the nozzle bore. During testing air was drawn through the airflow path 66 at a rate of 50 ml/s for about 3 seconds, using a vacuum pump.

Figure 12:
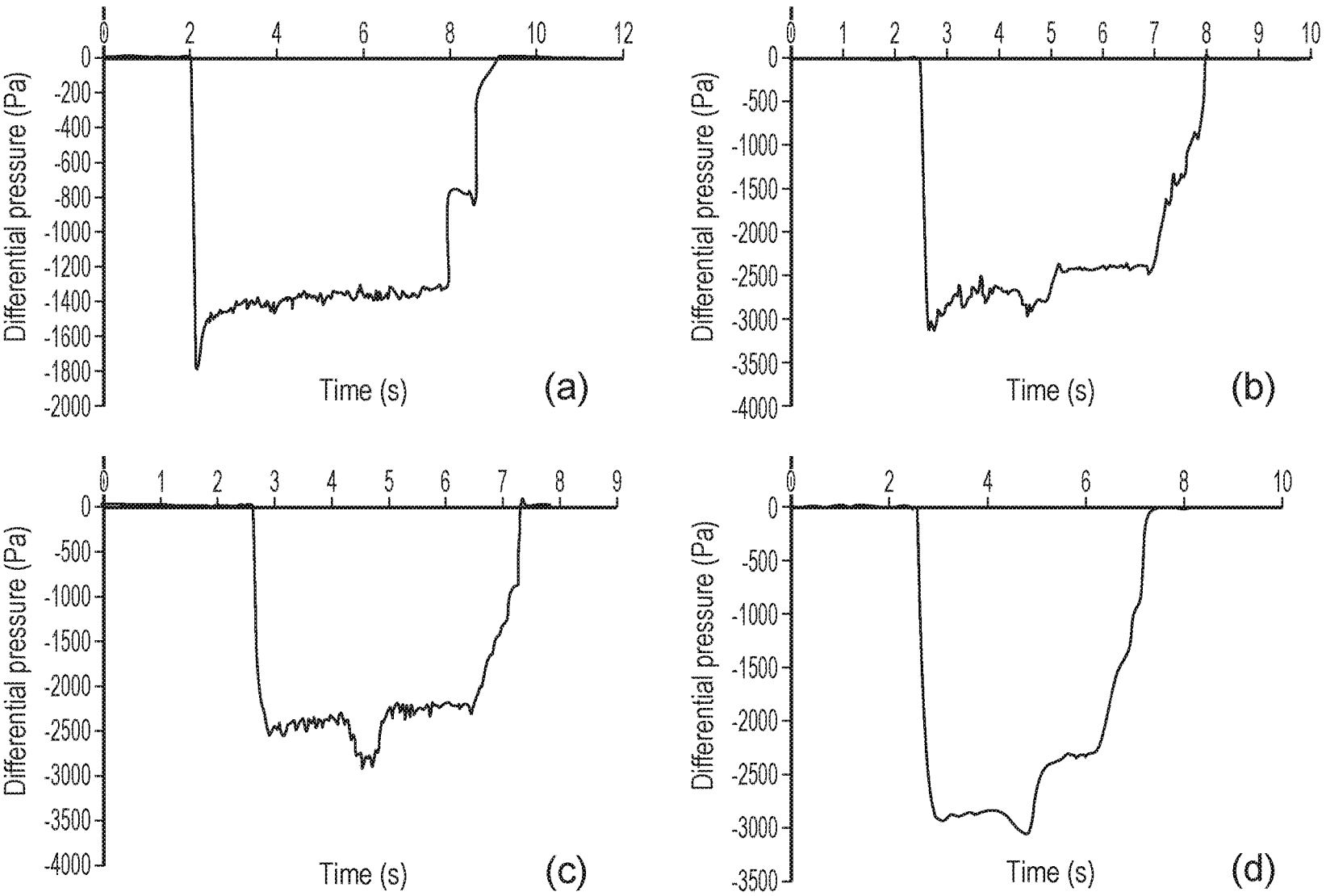
FIG. 12 shows graphs of pressure measurements recorded from the device of FIG. 8 with different nozzles.

FIG. 12 shows the results of these tests, as graphs of the pressure recorded by the sensor 62, normalized for atmospheric pressure. FIG. 12(*a*) shows the measurement from a control test in which no nozzle 70*b* was used, the open aperture into the chamber 62 having a 2 mm diameter. FIGS. 12(*b*), 12(*c*) and 12(*d*) respectively show the results for the 0.25 mm, 0.5 mm and 0.125 mm nozzle bores. These results show that, for a chamber sealed against air leaks, the nozzles do not attenuate the pressure signal recordable by the sensor in the chamber, even for the smallest diameter nozzle bore which will provide the most protection against liquid ingress. An accurate measurement of pressure in the airflow passage can be made by the sensor in the chamber.

In contrast, further tests carried out with air leaks deliberately introduced to the chamber showed a much reduced pressure signal compared to those for a sealed chamber. The effect is greater for a larger leak as compared to the size of the nozzle bore; for example a leak from a 0.25 mm hole reduced the signal magnitude recorded with a 0.125 mm nozzle by about 95%, but reduced the signal magnitude recorded with a 0.5 mm nozzle by about 20%. A leak comparable to or larger than the inlet to the chamber is able to equalize or near-equalize the chamber to atmospheric pressure so that little of the pressure from the air flow can be detected in the chamber. A smaller leak allows only partial equalization, so a higher proportion of the air flow pressure can be measured in the chamber. As a conclusion, a chamber properly sealed for airtightness ensures that the maximum amount of pressure signal can be detected in the chamber.

The ability of nozzle restrictors to resist liquid seepage was also tested. Holes ranging in diameter from 0.5 mm to 2.0 mm were drilled into Perspex® sheet. A first set of holes was closed at the end, i.e. did not pass right through the sheet. A second set of holes was also closed, and the surrounding sheet material was treated with a spray coating of hydrophobic material (NeverWet®). A third and a fourth set of holes were open at the end, i.e. passed right through the sheet, in untreated and treated material respectively. Liquid in the form of nicotine solution for e-cigarettes was deposited onto each hole, and the degree of penetration into the hole was observed.

The closed holes without hydrophobic treatment showed a little penetration, with more for larger diameter holes. The open holes without hydrophobic treatment showed penetration of all the holes. Surface treatment enhanced the holes' performance considerably. For the open holes, the larger diameter holes showed penetration but the hydrophobic material was able to resist liquid penetration into the narrower holes. For the closed holes, only the largest showed any liquid penetration, and that was only partial. The hydrophobic material causes the liquid to pull into a bead or droplet, the surface tension of which stops it from flowing into the hole. More energy would be required to overcome this and force liquid into the hole, so that the balance of energy is tipped against liquid ingress. The effect will be enhanced if the inside surface of the hole also has a hydrophobic surface. While more elaborate surface coating might be used to achieve this, an alternative is to make a nozzle restrictor from an inherently hydrophobic material, such as the PEEK nozzles discussed above.

Also, the closed holes were much more effective at preventing liquid ingress than the open through holes. This is because the liquid acts to seal a volume of air in the bottom of the hole, and as the liquid attempts to penetrate further into the hole this air is compressed and generates a back pressure to resist the liquid, balancing the weight of the liquid to prevent further ingress. This effect is absent in an open hole where no air can be trapped. In the context of protecting a sensor within a chamber, the closed and open holes are similar to an airtight chamber and a leaky chamber. The chamber volume will be greater than the volume of the test holes, however, so less back pressure will be generated and the protective effect may be diminished. It will still provide some effect, however, so that it is beneficial to attempt an airtight seal of a chamber used with a nozzle restrictor.

Further seepage testing was carried out using the nozzle test rig 82 shown in FIG. 11. The nozzle bore diameter was 0.25 mm and the nozzle was made from PEEK. A leak simulation test protocol like that described with respect to FIGS. 8 and 9 was applied.

Figure 13:
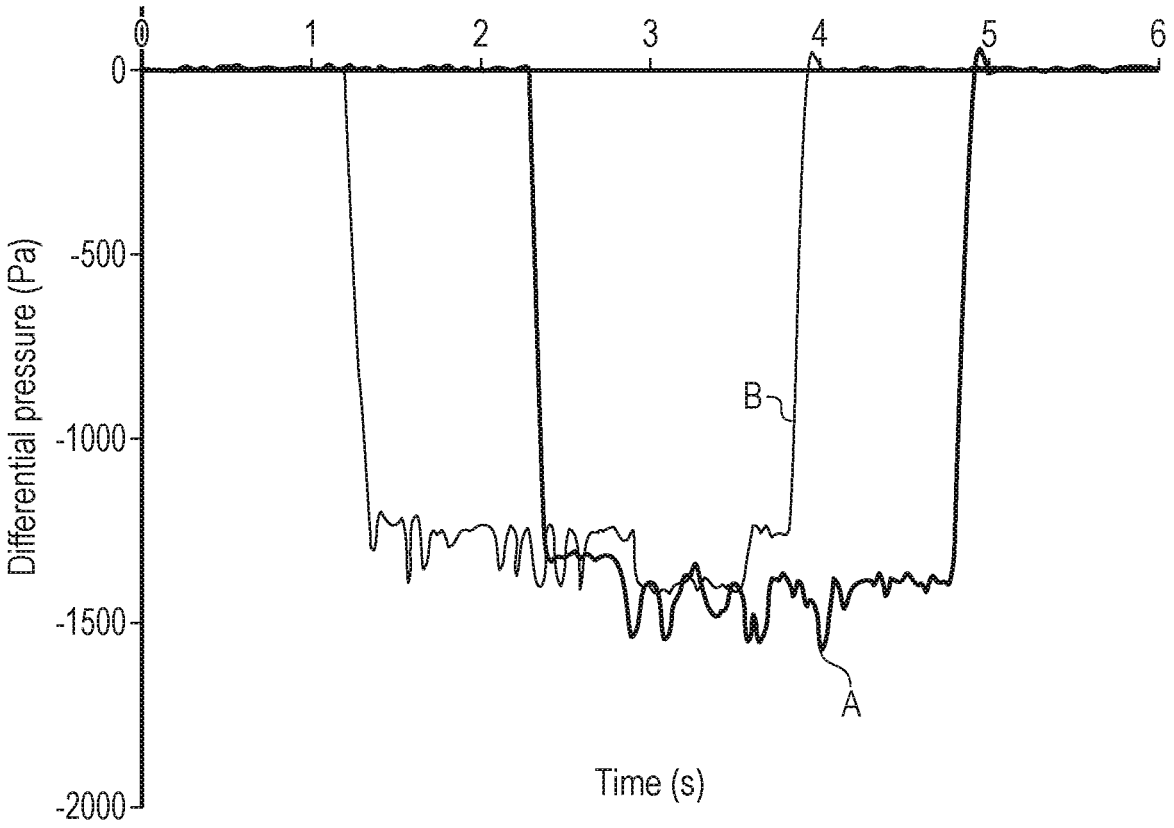
FIG. 13 shows a graph of pressure measurements recorded from the device of FIG. 11 before and after leak testing.

FIG. 13 shows the results of this test. Lines A and B respectively show the pressure detected in the chamber before and after the leak simulation. The recorded pressure is very similar for each test, indicating no damage to the sensor from liquid ingress, and no effect on sensor performance from any residual liquid remaining on, around or inside the nozzle after the leak.

For the particular application of an aerosol provision system such as an e-cigarette, the results indicate that a nozzle with a bore width of about 0.5 mm or less will be effective, including 0.3 mm or less, 0.25 mm or less and 0.125 mm or less. For other applications, nozzles of other dimensions may be preferred.

Valve Restrictor

Alternatively, a valve may be used as a liquid flow restrictor. A one-way valve, configured to open and allow flow (of gas or liquid) in one direction but remain closed to block flow in an opposite direction, can be located in the airflow path so as to allow air to pass in the incoming inhalation direction (from the inlet holes 24 to the mouthpiece 35 in FIG. 1), but to block liquid flow in the opposite direction (from the reservoir 38 and heating element 40 towards the chamber 60 and air inlets 24 in FIG. 1). If placed downstream from the sensor with respect to the airflow direction and upstream from the sensor with respect to the liquid flow direction, any leaking liquid will be inhibited from reaching the sensor, while still allowing the sensor to experience the airflow in the airflow path and detect the corresponding pressure changes.

In such an arrangement, consideration may be given to the "cracking pressure", which is the amount of pressure from incident air flow which is required to open the valve. The device in which the liquid flow restrictor is to be used may have an intended operating pressure corresponding to airflow during normal operation of the device, and if the cracking pressure exceeds this operating pressure, the device may become inoperable or more difficult or more awkward to use. For example, in an e-cigarette, the airflow generated by a user inhalation produces the operating pressure. Typically, this is of the order of 155 Pa to 1400 Pa at an air flow rate of 5 to 40 ml/s. If a valve having a cracking pressure in excess of this is installed in the airflow path, the user will have to inhale more forcefully to cause the valve to open, which may be considered undesirable. The valve will also occupy space in the airflow path, providing resistance to the airflow so that when opened a larger pressure may be required to generate the desired flow rate than if the valve were absent. Also, if the valve has an obvious step-change in its operating characteristics, such that it is closed below the cracking pressure and nearly or fully open immediately the cracking pressure is exceeded, an unwanted effect discernible to the user may be produced. A valve that opens more gradually with increasing pressure might be preferred, to avoid a perceivable cracking pressure.

Any type of one-way valve of a suitable size and operating characteristic for a particular device and its intended use might be employed as a liquid flow restrictor in the context of embodiments of the disclosure. For example, a spring valve or a duck-bill valve may be used.

Figure 14:
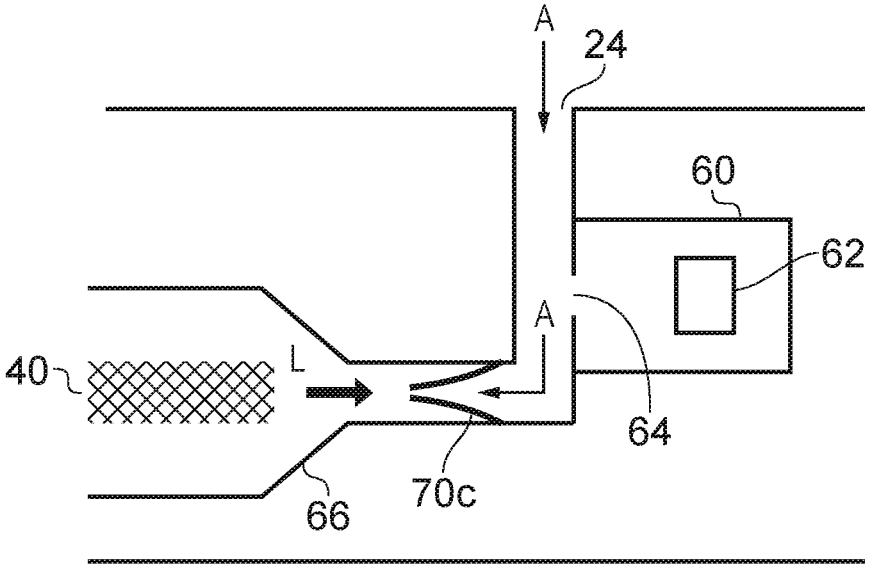
FIG. 14 shows a schematic cross-sectional representation of an example device in accordance with a valve embodiment of a liquid flow restrictor.

FIG. 14 shows a schematic cross-sectional representation of part of an e-cigarette fitted with a valve such as a duckbill valve, similar to the device shown in FIG. 2. Air enters through one or more holes 24 in the side of the device and flows along an airflow path 66 to a heating element 40. A chamber 60 houses a sensor 62 to detect pressure changes in the airflow path 66 through an aperture 64. Subsequent to the aperture, with respect to the air flow direction A, a one-way valve 70*c* is fitted in the airflow path 66, in front of the heating element 40. Under the action of a sufficient pressure of incoming air the valve 70*c* opens to allow air onto the heating element 40. With no airflow, the valve 70*c* remains closed, and prevents or inhibits the flow of liquid L from the heating element 40 towards the chamber 60.

Each of the various liquid flow restrictor embodiments may be used in the example configurations of FIGS. 3, 4 and 5, or similar configurations of chamber, sensor, airflow path and restrictor arranged to have the same or similar function. Also, two or more restrictors might be employed together to enhance the effect of protecting the sensor from exposure to liquid. For example, a single device might include both a mesh and a nozzle. Two restrictors might be situated in a common location with respective to the airflow path, such as both in the aperture in a FIG. 3 device to give a combined flow-bypass arrangement, or both in the airflow path in a FIG. 4 device to give a combined flow-through arrangement. Alternatively, they might be spaced apart with one in a flow-bypass position and one in a flow-through position.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A device for controlling electrical power supply in response to air pressure measurement, the device comprising:

an airflow path;

a chamber having an aperture;

a liquid flow restrictor configured to inhibit ingress of liquid into the chamber via the aperture;

a pressure sensor located in the chamber and operable to detect, in the presence of the liquid flow restrictor, air pressure changes caused by air flow in the airflow path; and a circuit for converting air pressure changes detected by the pressure sensor to control signals for controlling output of power from a battery located outside the chamber.

2. The device according to claim 1, wherein the pressure sensor is operable to detect, in the presence of the liquid flow restrictor, an air pressure change in a range of 155 Pa at an airflow in the airflow path of 5 ml per second to 1400 Pa at an airflow in the airflow path of 40 ml per second.

3. The device according to claim 1, wherein the airflow path lies outside the chamber and is in communication with the aperture.

4. The device according to claim 3, wherein, with the exception of the aperture, the chamber is airtight.

5. The device according to claim 1, wherein the aperture is an air outlet for the chamber, the chamber further comprises an air inlet, and the airflow path passes through the chamber and includes the aperture and the air inlet.

6. The device according to claim 1, wherein the liquid flow restrictor is arranged in or across the aperture.

7. The device according to claim 1, wherein the liquid flow restrictor is arranged in or across the airflow path.

8. The device according to claim 1, wherein the liquid flow restrictor comprises a mesh.

9. The device according to claim 8, wherein the mesh has a surface layer of hydrophobic material or is made from hydrophobic material.

10. The device according to claim 8, wherein the mesh has a pore size of 100 μm or less.

11. The device according to claim 1, wherein the liquid flow restrictor comprises a nozzle with a bore.

12. The device according to claim 11, wherein the nozzle is made from or has a surface coating of hydrophobic material.

13. The device according to claim 12, wherein the nozzle is made from polyether ether ketone.

14. The device according to claim 11, wherein the bore of the nozzle has a diameter of 0.5 mm or less.

15. The device according to claim 1, wherein the liquid flow restrictor comprises a one-way valve configured to open under the pressure of air flow in the airflow path in a first direction and be closed against liquid flow in an opposite direction.

16. The device according to claim 1, further comprising a battery responsive to the control signals from the circuit.

17. The device according to claim 1, wherein the device is a component of an aerosol provision system.

18. An aerosol provision system comprising the device for controlling electrical power supply in response to air pressure measurement according to claim 1.

19. A device for controlling electrical power supply in response to air pressure measurement, the device comprising:

an airflow path;

a chamber;

an aperture opening from the airflow path into the chamber;

a liquid flow restrictor arranged in or across the aperture and configured to inhibit ingress of liquid into the chamber through the aperture, the liquid flow restrictor comprising a mesh or a nozzle with a bore;

a pressure sensor located in the chamber and operable to detect, in the presence of the liquid flow restrictor, air pressure changes caused by air flow in the airflow path; and a circuit for converting air pressure changes detected by the pressure sensor to control signals for controlling output of power from a battery.

20. A device for controlling electrical power supply in response to air pressure measurement, the device comprising:

an airflow path;

a chamber;

an aperture opening from the airflow path into the chamber;

a liquid flow restrictor arranged in or across the aperture and configured to be permeable to air and impermeable to liquid so as to inhibit ingress of liquid into the chamber;

a pressure sensor located in the chamber and operable to detect, in the presence of the liquid flow restrictor, air pressure changes caused by air flow in the airflow path; and a circuit for converting air pressure changes detected by the pressure sensor to control signals for controlling output of power from a battery.

* * * * *